United States Patent [19]

Dickhart, III et al.

[11] 4,295,428

[45] Oct. 20, 1981

[54] STEERABLE TRUCK FOR A RAILWAY VEHICLE

[75] Inventors: William W. Dickhart, III, Ft. Washington; Richard H. Marvin, Philadelphia, both of Pa.

[73] Assignee: The Budd Company, Troy, Mich.

[21] Appl. No.: 29,720

[22] Filed: Apr. 13, 1979

[51] Int. Cl.[3] ..... B61F 3/08; B61F 5/20; B61F 5/30

[52] U.S. Cl. ..... 105/168

[58] Field of Search ..... 105/167, 168, 176, 199 R, 105/202, 206 R, 208, 211

[56] References Cited

U.S. PATENT DOCUMENTS

| | | | |
|---|---|---|---|
| 2,195,772 | 4/1940 | Farrell | 105/261 R |
| 3,631,816 | 1/1972 | Miller | 105/261 R |
| 3,789,770 | 2/1974 | List | 105/168 |
| 4,170,179 | 10/1979 | Vogel | 105/168 |

*Primary Examiner*—Richard A. Bertsch
*Attorney, Agent, or Firm*—A. L. Trueax, Jr.

[57] ABSTRACT

A forced steering mechanism is connected to a truck to steer an axle and associated wheels. Coupling means are provided for loosely connecting the car body of a vehicle to the truck and the forced steering mechanism. The coupling means permits relative lateral movement between the car body and truck while maintaining the forced steering mechanism in a position so as to permit self steering, but no forced steering when the vehicle is moving over tangent or rectilinear tracks. At the same time the degree of such lateral movement and amount of self steering is limited. The coupling means causes the forced steering mechanism to become operative when the vehicle is moving over sharply curved tracks.

9 Claims, 8 Drawing Figures

74
42
73
72
42
71
75
63
70
76
77
65
61
60
56
78
87
52
58
46
62
88
54
64

FIG. 7
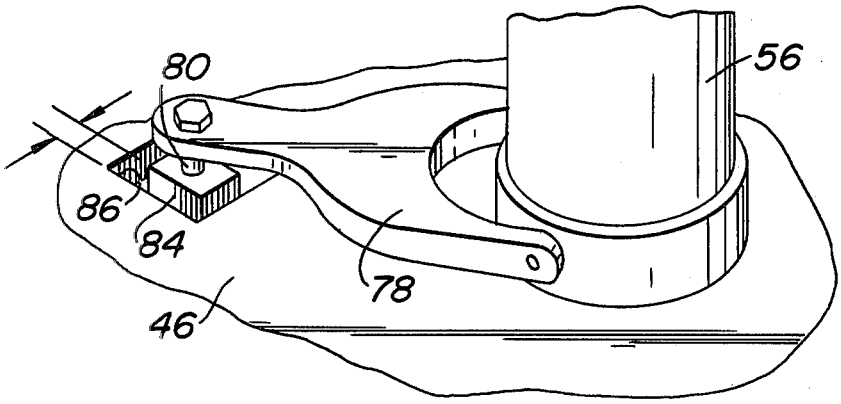
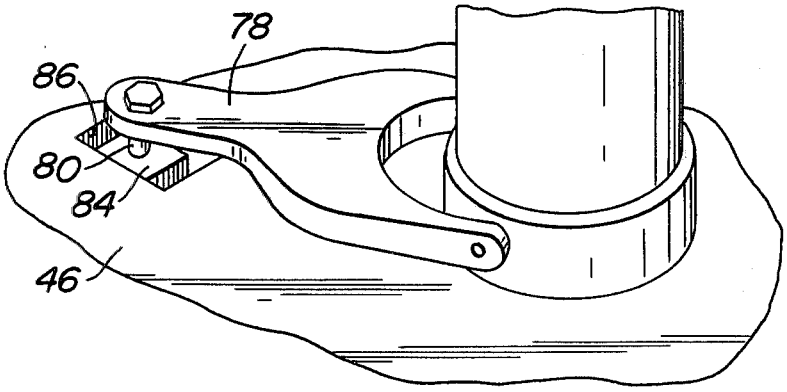
FIG. 8

STEERABLE TRUCK FOR A RAILWAY VEHICLE

SUMMARY OF THE INVENTION

Many conventional railway trucks include axles of wheels mounted to side frames which remain substantially parallel with respect to each other when the wheels are moving across curved tracks. Because the axles do not move radially with respect to the curved tracks on which the railway vehicle is traveling, the flanges of the wheels strike the curved tracks at an angle. This results in noise when the vehicle is traveling on a curved track. In addition, the wheel flanges tend to wear and eventually cause noise even when the vehicle is traveling along a straight track. Lack of adequate truck steering in a trolley car making very sharp turns around a corner, for example, may cause extremely high noise resulting from the flanges of the wheels rubbing against the tracks.

To minimize the above problems of wear and noise, self steering articulating railway trucks and forced steering have been designed to allow the wheels to become positioned on curved tracks substantially radial to the curve involved. One typical patent illustrating forced steering of a truck is disclosed in a patent to List, U.S. Pat. No. 3,789,770. Other systems have involved self-steering and are satisfactory within limited conditions. However, under extreme conditions involving sharp curves in the tracks, a form of forced steering is desirable. However on tangent tracks, limited lateral movement without forced steering is desirable while still permitting a limited amount of self steering.

While the above patent and other systems are satisfactory in many respects, they fail to take into account situations in which limited lateral movement with self steering of the car body and no forced steering of the axles is desirable. A situation in which forced steering of the axles on the truck is not required is when the vehicle is traveling along relatively straight or tangent tracks. During these times, a certain amount of lateral displacement with self steering of the car body with respect to the truck without forced steering is desirable. Of course, even during this type of travel, it is desirable to limit extreme lateral movements and self steering of the car body.

When extremely sharp curvatures are encountered by a vehicle, especially trolley cars where very often turning corners is involved, forced steering of the axles of the truck is generally necessary to maintain them radial to the tracks. While relying on self steering may be acceptable during most of the operation of many railway vehicles, when sharp curves are encountered, the self steering is generally not sufficiently reliable and a form of forced steering must be used. Consequently, for many systems, especially involving trolley car operations requiring sharp curves, it is desirable to have a system which utilizes force steering only on curvilinear tracks but not on tangent tracks while at the same time limiting the degrees of lateral movement and self steering on tangent tracks.

It is an object of this invention to provide an improved steerable truck for a railway vehicle.

It is a further object of this invention to provide an improved steerable truck which permits limited lateral movement and self steering of the truck with no forced steering when the vehicle is riding over tangent tracks while applying forced steering when the vehicle is riding over sharply curved tracks.

In accordance with the present invention, a railway vehicle includes a car body and a truck for supporting a car body, with the truck including a pair of axles each having a pair of wheels mounted thereto. A forced steering mechanism is attached to the truck connected to steer at least one of the axles and a pair of wheels. Means are provided for loosely connecting the car body to the truck and the forced steering mechanism to permit relative, but limited, self steering and lateral movement between the car body and the truck, with no forced steering mechanism, when the vehicle is moving over tangent tracks. The forced steering mechanism is forced into operation when said vehicle is moving over tracks having relatively sharp curvatures.

Other objects and advantages of the present invention will be apparent and suggest themselves to those skilled in the art, from a reading of the following specification and claims, taken in conjunction with the accompanying drawings, in which:

FIGS. 7 and 8 are isometric views of elements involved in the forced steering of the truck in two different positions in accordance with the present invention;

Figure 1:
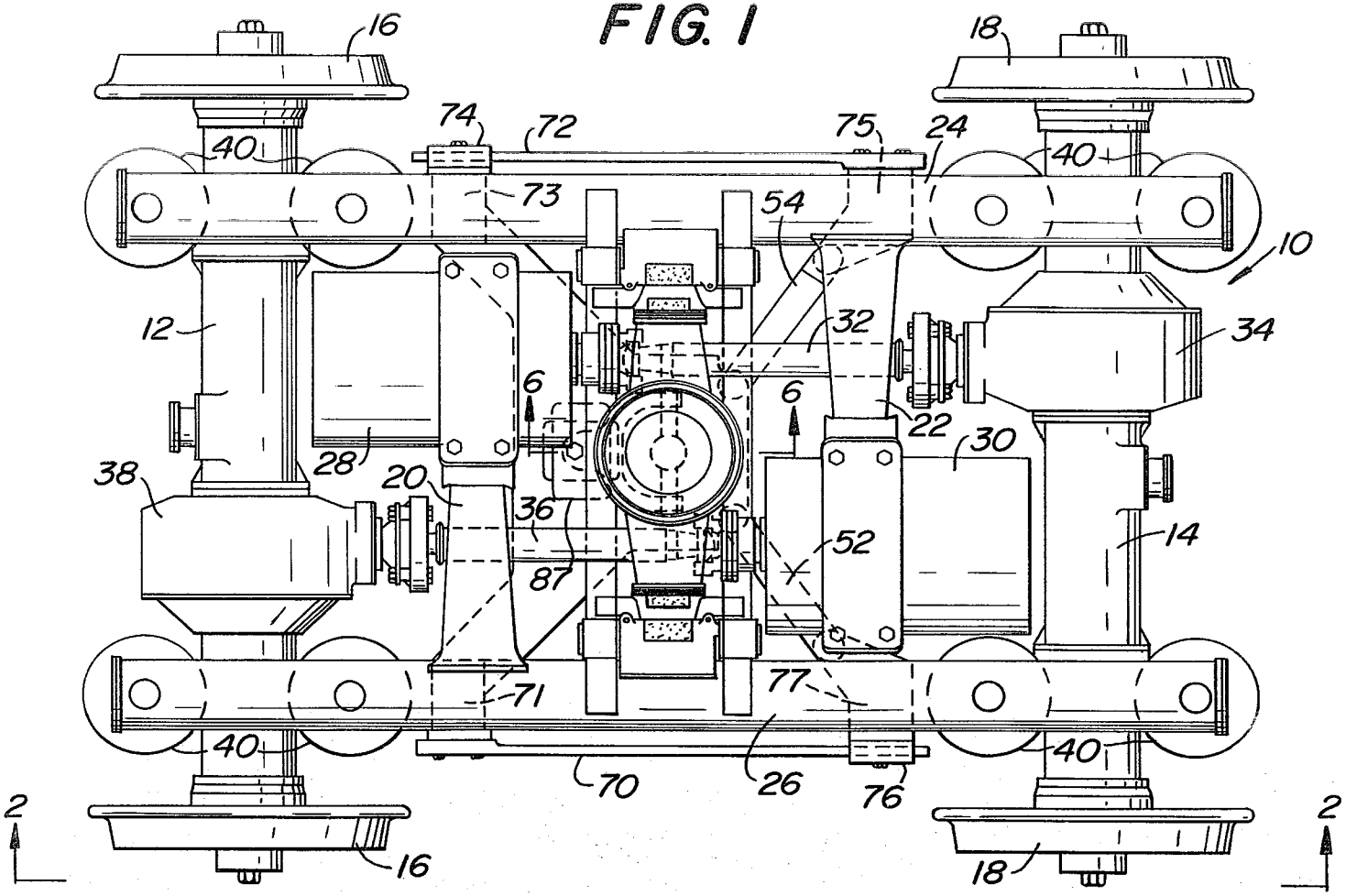
FIG. 1 is a top view of a steerable truck for a railway vehicle, in accordance with the present invention.
Figure 2:
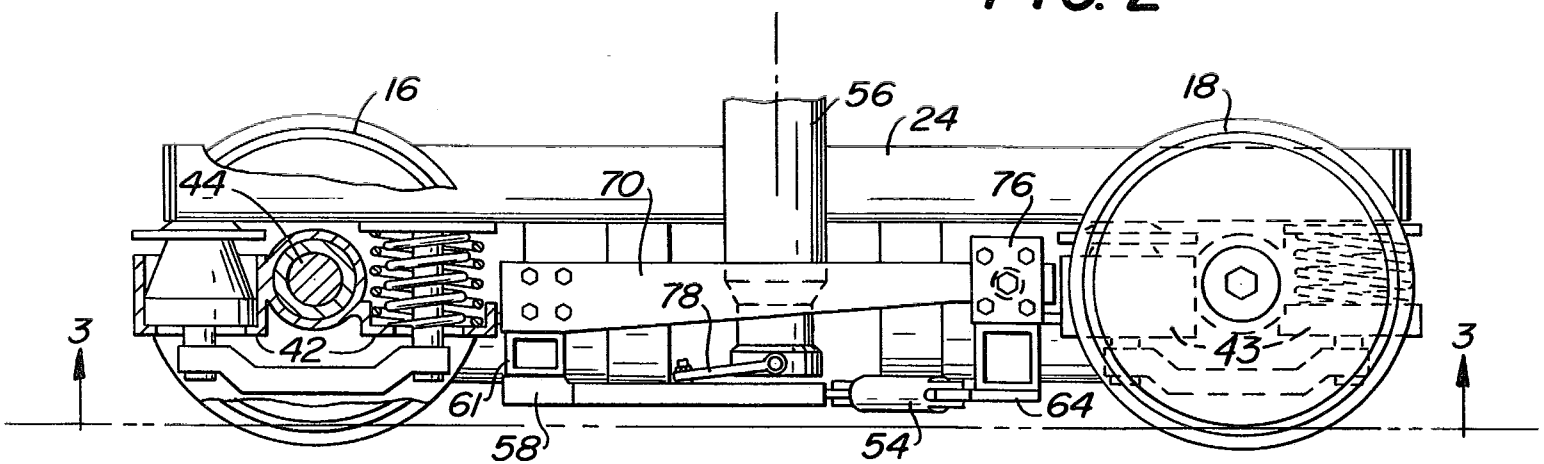
FIG. 2 is a side view, taken along lines 2—2 of FIG. 1.
Figure 6:
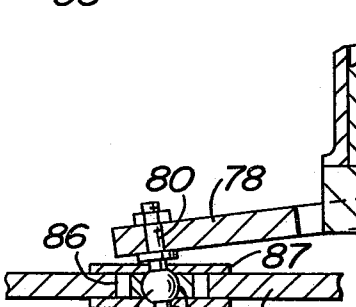
FIG. 6 is a cross-sectional view taken along lines 6—6 of FIG. 1.
Figure 3:
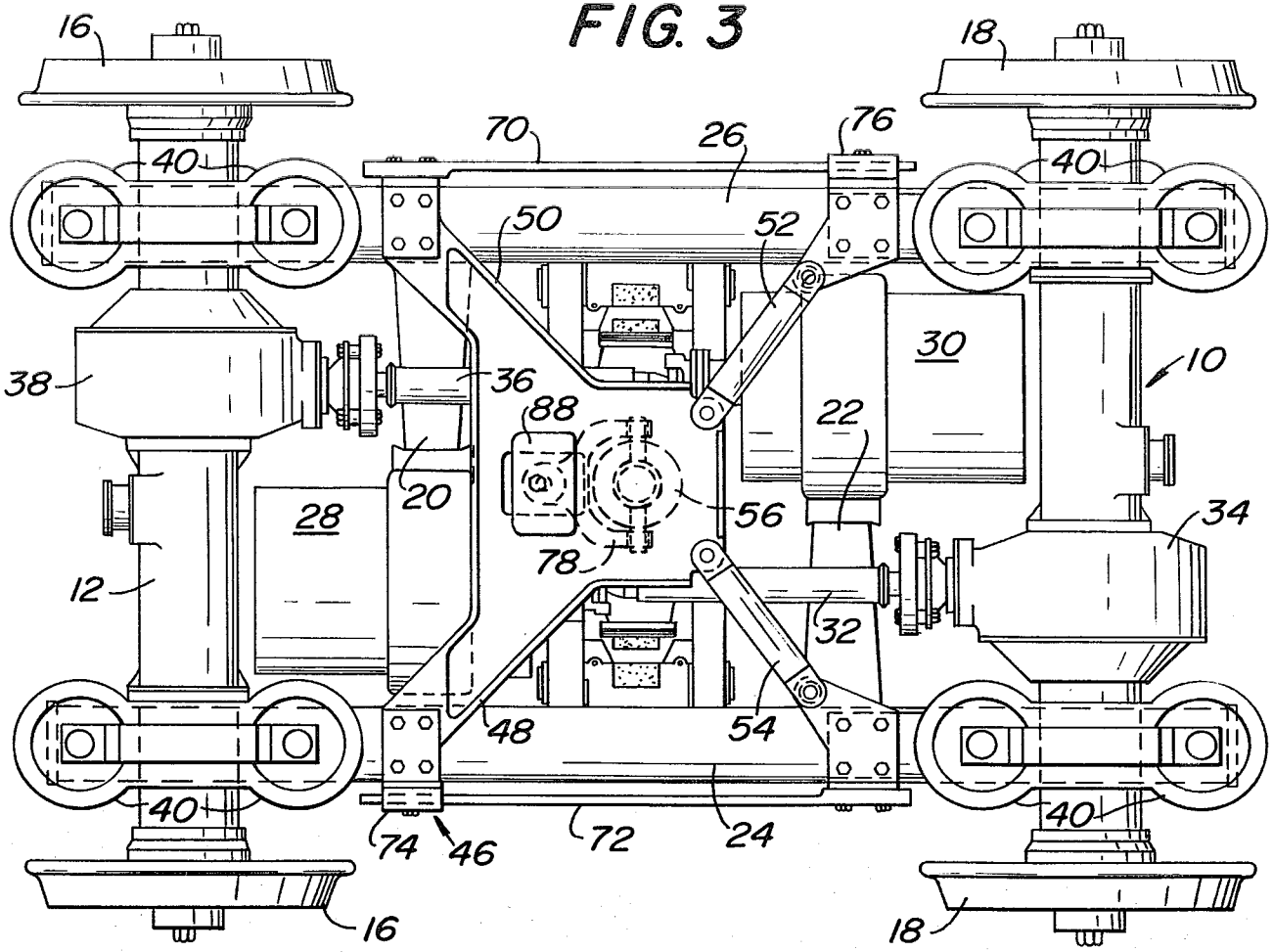
FIG. 3 is a bottom view, taken along lines 3—3 of FIG. 2.

Referring to FIGS. 1, 2 and 3, a steerable truck 10 includes features which permits limited lateral movement of the car body (not illustrated) without causing forced steering when the car is riding over tangent or rectilinear tracks. At the same time, limited self steering of the truck is permitted. When the truck is going over sharply curved tracks, a forced steering of the truck takes place, as will be described.

The steerable truck 10 includes many of the basic structure elements found in conventional trolley cars, for example. The truck 10 includes a pair of axle housings 12 and 14 each including pairs of wheels 16 and 18, respectively. A pair of transoms 20 and 22 are connected between side frames 24 and 26.

Drive motors 28 and 30 are connected to the transoms 20 and 22, respectively. A drive shaft 32 is connected from the motor 28 to a gear box 34 which is mounted on the axle housing 14. In like manner, a drive shaft 36 is connected from the motor 30 to a gear box 38, which is mounted on the axle housing 12.

A plurality of pairs of springs 40 are nested in suitable rear spring seat members and on movable front seat members 43 which in turn are supported on the axles 44 of the rail car by suitable mechanical means. The pairs of springs 40 support the side frames 24 and 26. The components thus far described are conventional and found in many types of trolley cars and their operations and functions will not be described in detail.

Figure 4:
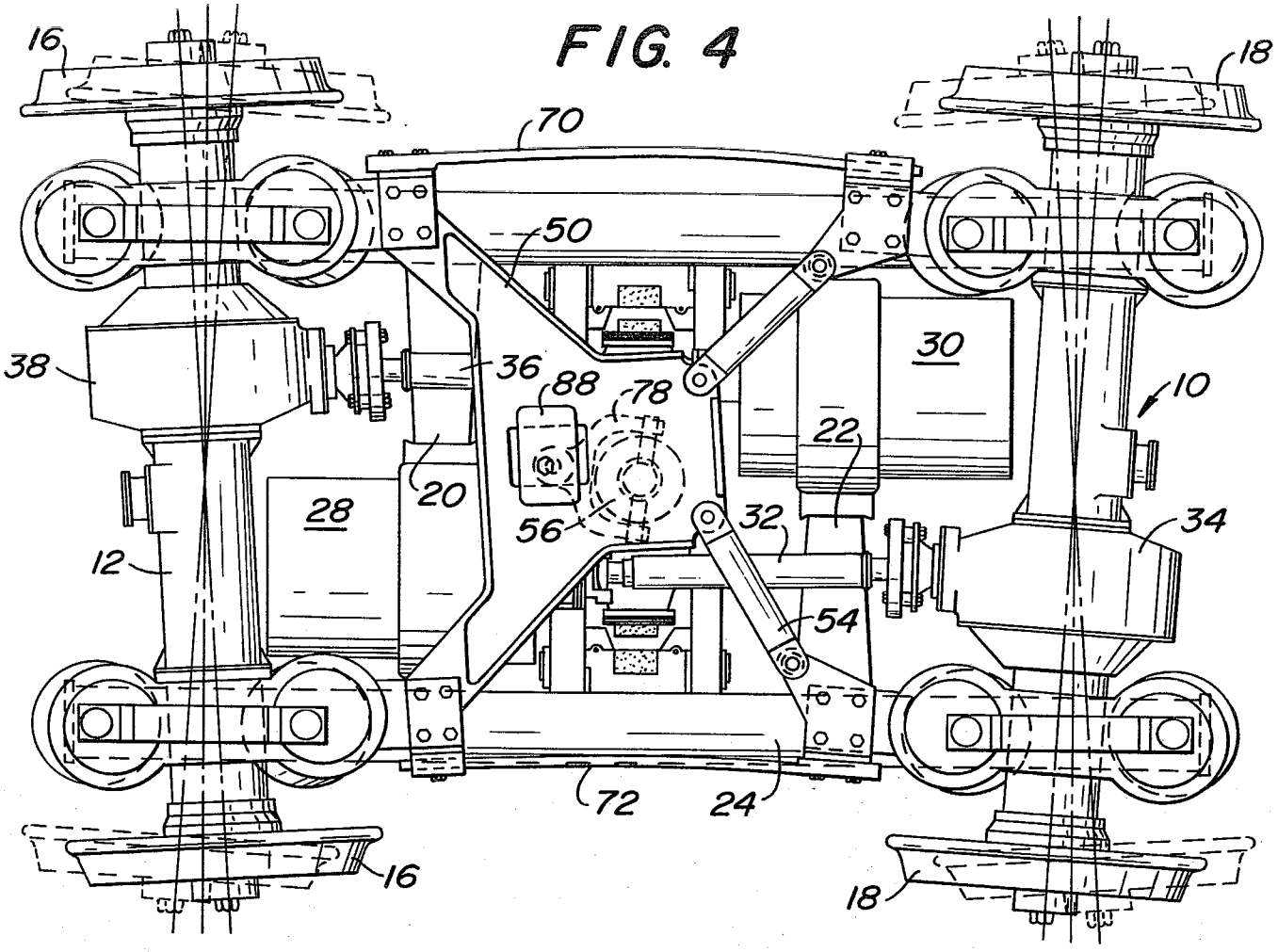
FIG. 4 is a view somewhat similar to FIG. 3, illustrating the truck as it is steered in opposite directions.

The forced steering mechanism in conjunction with the other components of the truck is best illustrated in FIGS. 3 and 4, with the details relating thereto being illustrated in other later FIGS. 5–8.

A steering frame 46 is secured to the bottom of the side frames 24 and 26. The steering frame 46 may be considered for purposes of explanation as comprising four arms 48, 50, 52 and 54. The steering frame 46 is held by mechanism extending from a king pin 56 connected from the car body to the steering frame. The arms 48 and 50 are fixed with respect to each and connected to the rear spring seats 42 through elements which will be described in connection with FIG. 5. The arms 52 and 54 comprise links which are pivotally mounted to the steering frame 46 at one end. The other ends of the link arms 52 and 54 are connected to the movable front spring seats 43.

Figure 5:
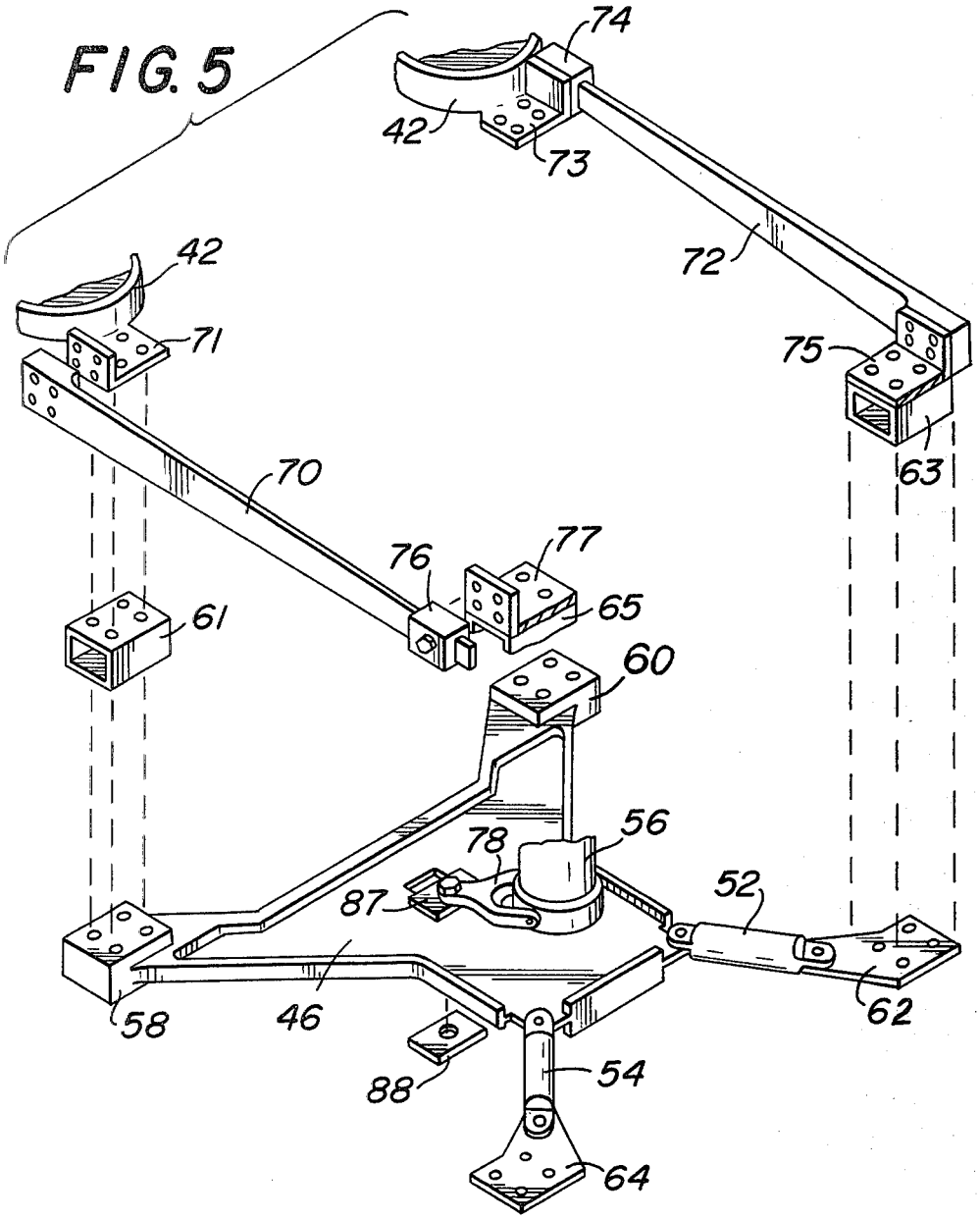
FIG. 5 is an exploded view illustrating some of the main components involved in the forced steering of the truck, in accordance with the present invention.

The steering frame 46, as illustrated in FIG. 5 and the other figures, comprises a plurality of bracket elements 58, 60, 62 and 64. The bracket elements 58 and 60 are connected to the ends of the arms 48 and 50, respectively. Bracket elements 62 and 64 are connected to the ends of the link arms 52 and 54, respectively. Brackets 58 and 60 are secured to the rear spring rest members 42 with the brackets 58 being connected through a spacer element 61 to a bracket 71 which is secured to one side of one of the rear spring rest members 42. The bracket element 60 likewise is connected to a bracket 73 secured to the other of the rear spring rest members 42. A spacer member, similar to spacer member 61 between brackets 60 and 73 is not illustrated.

The bracket 62 pivoted at the end of link arm 52 is connected through a spacer element 63 to bracket 75 which is mounted to one of the front spring rest members 43 (not illustrated in FIG. 5) in the same manner as the brackets 71 and 73 are mounted. The bracket 64 is secured through spacer member 65 to bracket 77 which is attached to one of the front spring rest members 43.

A pair of torsion bars 70 and 72 are connected on either side of the steering frame 46 beneath the side frames 24 and 26. The torsion bars 70 is connected between the various brackets 71 secured to the rear spring rest member 42 and a slide member 76. The torsion bar 72 is connected between the bracket 75 secured to the front spring rest member 43 and a slide member 74. The slide members 74 and 76 are secured to brackets 73 and 77 respectively. One end of the torsion bars 70 and 72 are fixedly mounted to brackets 71 and 75, respectively. The opposite end of the torsion bars 70 and 72 slideably mounted in slide members 76 and 74, respectively, to slide therein when the bars 70 and 72 are bent or twisted as when a forced steering operation takes place.

In FIG. 5, only one set of connecting elements is shown with one of the spring rest members 42. Also, only one set of connecting elements is shown with one of the front brackets 62 and spring rest member 43 (not illustrated). It is understood that similar connections also apply to the other spring rest members connecting brackets and spacing members not illustrated.

The overall effect of the steering mechanism of the present invention may be seen by reference to FIGS. 3 and 4. FIG. 3 illustrates the truck 10 as it rides along a tangent or rectilinear track. During this operation, the axle housings 12 and 14 are substantially parallel with respect to each other. The front and rear wheels 16 are also in alignment with respect to each other. During the travel on tangent tracks, the relatively loose connection, to be described, between the car body and truck permits limited lateral movement of the car body and some self steering without actuating the forced steering.

Referring to FIG. 4, the arrangement illustrated illustrates the truck as it is negotiating relatively sharp curvilinear tracks. The solid lines in FIG. 4 illustrate the positions of the various components in the truck as the curve is being negotiated in one direction. The dotted portions of the components in FIG. 4 illustrate the position of the various components in the system when a curve is being negotiated in the opposite direction. As mentioned, when the truck 10 is not negotiating turns, the car body associated with the truck is allowed to be moved laterally within limits while permitting some self steering. After the turn has reached a certain radius, the lateral movement and self steering is limited and the loosely connecting mechanism between the car and truck, to be described in connection with the present invention, becomes effective to cause forced steering of the truck, the operation of which is illustrated in FIGS. 5, 6, 7 and 8.

The king pin 56, connected to the car body, is adapted to rotate with respect to the truck 10 and steering frame 46 when curved tracks are encountered. The king pin 56 is attached to the car body and rotates therewith in a manner the king post 52 is shown and explained in U.S. Pat. No. 2,879,718. The end of the king pin 56 includes a forked yoke member 78 pivotally mounted thereto. The yoke 78 is adapted to move up and down with respect to the king pin 56 during operation. The yoke 78 may be considered as the steering yoke in the system.

The steering yoke 78, which may comprise double prongs at one end connected to the king pin 56, is loosely connected to the steering frame 46 through a number of elements. The end of the yoke 78, not connected to the king pin 56, is adapted to receive a downwardly extending pin 80 held in place by two retainer rings. The pin 80 includes a ball socket arrangement including a self aligning mono-ball 82 adapted to move in a block 84 to provide a rotary joint.

Top and bottom plates 86 and 88 are provided above and below the ball socket arrangement and in contact with the steering arm 46. The steering frame 46 includes a rectangular aperture 86 adapted to receive the block 84 therein. Top and bottom plates 87 and 88 are disposed on either side of the block 84 and frame 46 and move with the pin 80. The block 84 is driven by the pin 80 and ball 82 and is loosely fitted in the aperture 86 so that it can move between predetermined limits, as indicated by the arrows in FIG. 7, before contracting the steering frame 46.

When the king pin 56 is rotated with respect to the truck, indicating that the car body is negotiating a turn, the yoke member 78 will move the block 84 through the pin 80 and ball 82. When the curve of the tracks is relatively small, the block 84 will move but will not move a sufficient distance to contact the edges of the steering frame 46 and forced steering will not become effective. When the king pin 56 is rotated about some predetermined number of degrees, indicative of sharply curved tracks, the block 84 contacts the steering frame 46, as illustrated in FIG. 8. Continued subsequent movement of the king pin 56 will then force the forced steering operation to take place, of the type illustrated in FIG. 4. It is noted that when sharp turns are not being negotiated, the arrangement involving the block 84 contacting the steering arm 46 also acts as a limit for the lateral motion of the car to prevent any self steering of the truck.

Consider the operation when the truck 10 is riding over a tangent track. In this event, the wheels 16 wil not be effected by forced steering mechanism. However, a certain amount of self steering of the wheels will be present. At the same time, the car body disposed on top of the truck may move laterally permitting some self steering without causing the forced steering. Although the truck is riding on a tangent track, it is undesirable to have the self steering effective in the presence of excessive lateral motion. This could cause derailing and is prevented by the block 84 moving within predetermined limits and then preventing lateral motion and self steering even on straight tracks.

When the truck 10 is negotiating a very sharp turn, it is important that the forced steering come into effect and that reliance on the self-steering feature alone be avoided. The present invention provides this forced steering. As illustrated in FIGS. 7 and 8, when the block 84 comes into contact with the steering arm 46, the rotation of the king pin 56 will force the steering arm 46 to move. As illustrated in FIGS. 3 and 4, when the truck is steered, the angular positions of the arms 52 and 54 connected to the steering arm 46 will vary dependent upon the direction of the curve.

When the steering frame 46 is moved by the king pin 56, the links or arms 52 and 54 are pivotedly rotated on the steering frame causing brackets 62 and 64 to be moved in one direction or the other. The brackets 62 and 64, being connected to the brackets 75 and 77, cause the front spring seat rests 43 to be turned in one direction or the other. The springs 40 within the spring set rests 43 are designed to flex and move and the spring rests 43 are dimensioned to permit limited movement of the springs 40 therein.

The flexure elements or torsion bars 70 and 72 are designed for before and after movements and to flex, with the ends thereof sliding in the slide members 74 and 76 during a forced steering operation. Turning of the arms 52 and 54 causes the associated pairs of springs to be moved slightly to cause the front axle and corresponding wheels to steer and remain radial with respect to curved tracks. The springs 42 are mechanical springs to permit them to be twisted or moved laterally through some predetermined angle without affecting their operation.

When the front links 52 and 54 are angularly moved, the rear arms 48 and 50 causes the spring rest members 42 connected thereto through brackets connections from bracket 58 to bracket 71 and bracket 60 to bracket 73 to be moved or twisted. This causes the springs 40 nested therein to be displaced. This causes the rear axle and associated wheels to remain radial with the tracks during sharp turns. It is seen that the front and rear wheels will follow the curvature of the track during sharp turns because of the forced steering mechanism provided.

The present invention has provided a combination which permits limited lateral movement and self steering of a railway car when passing over tangent or rectilinear tracks. At the same time, when greatly excessive curves are encountered, no self-steering takes place and the forced steering mechanism will operate to force the axle wheels into a radial position with respect to sharp curves being negotiated.

What is claimed is:

1. In a railway vehicle having a car body for use on rectilinear and curvilinear pairs of tracks, the combination comprising:

a. a truck for supporting said car body, b. said truck including a pair of axles each having a pair of wheels mounted thereto, c. a forced steering mechanism attached to said truck connected to steer at least one of said axles and a pair of wheels, said forced steering mechanism comprises a steering frame including at least two pivotable arms attached thereto to steer one of said pair of axles and two additional arms attached to steer the other of said pair of axles when forced steering becomes effective on curved tracks exceeding predetermined curvatures, and d. means for loosely connecting said car body to said truck and said forced steering mechanism to permit limited relative lateral movement and self steering between said car body and said truck with said forced steering mechanism being maintained ineffective to cause forced steering when said vehicle is moving over rectilinear tracks, and to restrict said lateral movement and self steering and render said steering mechanism effective to cause forced steering when said vehicle is moving over curvilinear tracks exceeding predetermined curvatures.

2. The invention as set forth in claim 1 wherein said means for loosely connecting said car body to said truck and said forced steering mechanism comprises a king pin attached to said car body for pivotally connecting said body with said truck and permitting movement therewith relative to said truck, and a yoke member connected between said king pin and said steering frame.

3. The invention as set forth in claim 2 wherein said steering frame includes an aperture, and a block member smaller in dimension than said aperture is connected to said yoke member and disposed within said aperture for limited movement therein in accordance with the movement of said king pin.

4. The invention as set forth in claim 3 wherein movement of said king pin beyond predetermined limits causes said block member to engage and move said steerable frame to cause said pivotable and additional arms thereof to steer said truck, with said steering frame being ineffective while said block is moving inside of said aperture.

5. The invention as set forth in claim 4 wherein said truck comprises a pair of front sets of springs with front spring rest members and a pair of rear sets of rear spring rest members, with said front spring rest members being connected to said two pivotable arms and said rear spring rest members bieng connected to said two additional arms.

6. The invention as set forth in claim 5 wherein the movement of said steering frame moves said pivotable arms and said additional arms to move said front and rear spring rest members and cause said front and rear sets of springs to flex during a forced steering operation.

7. The invention as set forth in claim 6 wherein said torsional frame further comprises a pair of torsion bars connected between said front and rear seat rest members, said torsion bars flexing during a forced steering operation, said torsional brars each being fixedly mounted on one end and slidably mounted on the other end in opposite directions with respect to each other.

8. The invention as set forth in claim 4 wherein said block moves within said aperture when said vehicle is passing over rectilinear tracks and contracts said steering frame when said vehicle is passing over curvilinear tracks exceeding predetermined curvatures, the movement of said block within said aperture permitting relative lateral movement of said car body with respect to said truck and self steering of said truck.

9. The invention as set forth in claim 8 wherein excessive lateral movement of said car body with respect to said truck on rectilinear tracks causes said block to contract said steering frame to prevent said self steering.

* * * * *